US005121683A

United States Patent [19]

Bielfeldt

[11] Patent Number: 5,121,683

[45] Date of Patent: Jun. 16, 1992

[54] METHOD AND APPARATUS FOR A CONTINUOUSLY WORKING HEATING-PLATE PRESS

[75] Inventor: Frederich B. Bielfeldt, Eppingen, Fed. Rep. of Germany

[73] Assignee: Maschinenfabrik J. Dieffenbacher GmbH & Co., Eppingen, Fed. Rep. of Germany

[21] Appl. No.: 600,769

[22] Filed: Oct. 23, 1990

[30] Foreign Application Priority Data

Nov. 6, 1989 [DE] Fed. Rep. of Germany ..... 3936924

[51] Int. Cl.[5] ..... B30B 15/34

[52] U.S. Cl. ..... 100/38; 100/41; 100/93 P; 100/151; 100/154; 156/583.5; 264/120; 425/371

[58] Field of Search ..... 100/35, 38, 41, 93 P, 100/93 RP, 151-154; 156/583.5, 555; 198/833, 626.6, 626.4; 264/120; 425/371, 335

[56] References Cited

U.S. PATENT DOCUMENTS 3,761,209 9/1973 Hanton ..... 425/371 X
4,923,384 5/1990 Gerhardt ..... 100/93 RP X

FOREIGN PATENT DOCUMENTS 2205575 8/1973 Fed. Rep. of Germany ..... 425/371
3206558 9/1983 Fed. Rep. of Germany ... 100/93 RP
3206807 9/1983 Fed. Rep. of Germany ..... 425/371

*Primary Examiner*—Harvey C. Hornsby
*Assistant Examiner*—Stephen F. Gerrity
*Attorney, Agent, or Firm*—Foley & Lardner

[57] ABSTRACT

A continuously working heating-plate press is disclosed for use in the manufacture of particle boards, fiber boards, plastic boards or the like. The plate-press includes endless steel belts which are run around a fixed press table and a lowerable press ram via drive and tail drums, the press table and press ram defining an adjustable press gap. More particularly, the steel belts are supported by roller bars and transmit a pressure to the material drawn moving the material through the press gap. Heating plates are attached to the press table and press ram providing heat to the material in the press gap. In addition, first and second flexible heat transfer systems are located in a feeding area between the tail drums and the initial point of contact between the steel belts and roller bars and provide heat to the material drawn prior to entry in the press gap. The invention also includes a method for heating a continuously working heating-plate press.

15 Claims, 6 Drawing Sheets

Fig. 5
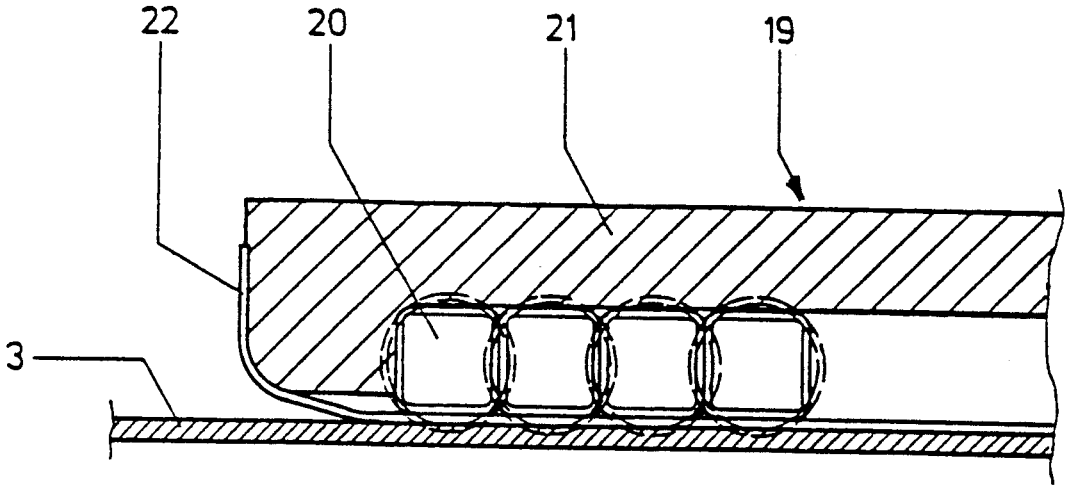
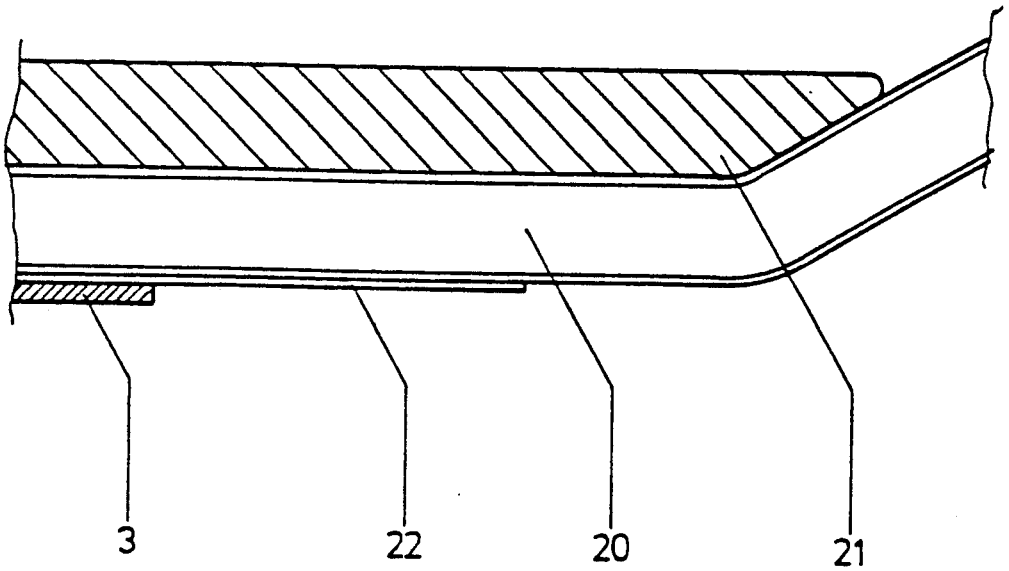
Fig. 6

35
30
21
16
13
22
32
19

METHOD AND APPARATUS FOR A CONTINUOUSLY WORKING HEATING-PLATE PRESS

BACKGROUND OF THE INVENTION

1. Field of the Invention

The invention relates to a continuously working heating plate press used in the manufacture of particle boards, fiber boards, plastic boards or the like. More particularly, the invention relates to a plate press comprising endless steel belts which are run around a fixed press table and a lowerable press ram via drive and tail drums, the press table and press ram defining an adjustable press gap. The steel belts transmit pressure to the material drawn moving the material through the press gap. The steel belts are supported by roller bars as they travel through the press, the roller bars having axes of the rotation transverse to the direction of the steel belts. Heating plates are attached to the press table and press ram providing heat to the material in the press gap via the roller bars and steel belts.

2. Description of the Related Art

The heat transfer in known continuously working heating-plate presses have rolling support. However, due to the line contact between the roller bars and the heating plates and the roller bars and the steel belts, the heat transfer is poor as compared to surface contact in cycle-controlled single-daylight presses. Consequently, the continuously working heating-plate press requires an increased use of lubricant to compensate for this disadvantage. The lubricant improves the heat transfer between the roller bars and the heating plates and steel belts in addition to its friction reducing function. The surface ratio of plate presses to rolling support is:

$$\text{surface} : \text{line} \hat{=} 100 : 1$$

However, it should be mentioned as a disadvantage that the quantity of heat that can be transferred (introduced) from the steel belts into the material to be pressed is still not sufficient to shorten the press time to such an extent that a continuous press can be built at an economical and technically still justifiable length. This is because it is known that the length of a continuous press depends on the press time and the yield, required per unit of time, of material to be pressed. A greater yield per unit of time requires a quicker passage and thus a greater press length. A greater press length in turn results in greater friction, larger drive drums, thicker steel belts and thus an inefficiently expensive continuous press.

A further disadvantage of known presses is that a far higher curing temperature is required by today's common binding agents. In addition, shorter curing times are continually being demanded. The required curing temperature of binding agents reacting especially quickly can be around 190° C. and higher. Therefore the material to be pressed, even if already preheated, must still be considerably heated in the hot press. Consequently, due to the limited heat transfer capabilities of existing presses, a larger overall press length or a slower passage (longer press time) through the continuously working press is required to introduce the necessary quantity of heat into the material to be pressed. The higher required curing temperature therefore increases the press time (reducing yield) or requires a considerable increase in the overall length of the press in order to increase yield. Until the pulse of steam for curing the glued particle mat is reached, a longer press distance is thus necessary. However, increasing press length cannot be done economically, which results in a restriction in the output capacity of the press.

The continuously working heating-plate press art lacks a press that can efficiently provide heat energy already within the press to meet the curing temperature requirements of today's binding agents without increasing press time, or increasing press length or reducing required material yield.

SUMMARY OF THE INVENTION

An object of the invention is to provide a continuously working heating-plate press with which it is possible to supply the material to be pressed with heat energy already in the feeding area of the steel belts and to thus shorten the press time.

The method according to the invention provides a continuous press with first and second flexible heat-transfer systems which act elastically on the top and bottom steel belts thereby making contact over their full surface, and giving off heat in the feeding area "A" to the material to be pressed. Technologically, it is of advantage here in that the requisite quantity of heat can be introduced more quickly into the material to be pressed in order to reach the steam point (start of cross-linking) earlier.

Another object of the invention provides the continuous press heat transfer system with pressure pads of a flexible and elastic design, which always follow the respective bending deformation (concave or convex) of the steel belts of the continuous press in such a way as to make contact over their full surface in a pliant manner and thus transfer the heat energy present in the pressure pads into the material to be pressed. It has been found by tests that, when the flexible heat-transfer system according to the invention is used, the heat transfer is higher than in a rolling support by a factor of ten.

It is of further advantage that, in the manufacture of particle boards, the flexible heat transfer system provides for earlier cross-linking of the particle boards due to an earlier pulse of steam.

Providing the press with additional pressure rolls and/or roller circulation shoes or roller cartridges creates an additional technological advantage due to the fact that a higher transverse tensile strength inside the particle boards can be achieved by the higher achievable compression.

Furthermore, providing the continuous press with additional roll compression and increased heat input that are controllable results in the technological advantage of requiring less pre-curing of the top layers of the particle board and thus less abrasion of the particle boards.

As a result of the invention, a continuously working press of substantially shorter length can be designed which provides the same performance as known presses. This is because the continuous press delivers the particle mat already pre-compressed and at a higher temperature into the entry area of the roller bars and subsequently to the high-pressure area of the press.

In accordance with one aspect of the invention, these objects are achieved by a continuously working heating-plate press which includes a press frame, a press ram and a press table connected to the press frame which define an adjustable press gap located in a pressing region therebetween. First and second endless steel belts transmit a pressing force to the material to be pressed and draw the material through a press gap. Driving drums and tail drums guide the first and second endless steel bands around the press ram and press table, respectively, and a plurality of revolving roller bars support the steel bands as they travel through the press. These roller bars have an axis of rotation transverse to the direction of the steel belts. In addition, first and second flexible heat transfer systems cooperate with the first and second steel belts, respectively, to provide heat to the material drawn in a feeding area which is located between the tail drums and the initial point of contact of the roller bars and steel belts.

In accordance with another aspect of the invention, the flexible heat transfer system includes a plurality of flexible pressure pads which make full surface contact with the steel belts by acting elastically on the steel belts and through which a heating media flows providing heat to the material drawn, and a compressive means located between the pressure pads and the press frame which provide a force to the pressure pads bringing them into contact with the steel belts.

In accordance with yet another aspect of the invention, the press includes a first and second series of flexible heat transfer systems cooperating with the first and second steel belts, respectively and where a rigid rolling pressure transfer system is arranged in front of each heat transfer system within the first and second series of flexible heat transfer systems to provide a pre-compression of the material to be pressed.

In accordance with still another aspect of the invention, the objectives are achieved by a method of heating a continuously working heating-plate press which comprises the steps of:

(a) providing a press frame;

(b) providing a press ram and a press table connected to said press frame to define an adjustable press gap located in a pressing region positioned therebetween;

(c) rotating first and second endless steel belts adapted to transmit a pressing force to a material to be pressed and to draw said material through said press gap;

(d) guiding said first and second endless steel belts around said press ram and said press table, respectively, via driving drums and tail drums;

(e) supporting said steel belts on a plurality of revolving roller bars as said steel belts travel through said press, said roller bars having axes of rotation transverse to the direction of said steel belts;

(f) transferring heat through said roller bars and said roller belts and into said material to be pressed from a pair of heating plates, said heating plates being attached to an upper side of said press table and an underside of said press ram, respectively; and (g) transferring heat to said material to be pressed from first and second flexible heating systems which cooperate with said first and second steel belts, respectively, and which are located in a feeding area of said press located between said tail drums and an initial point of contact between said steel belts and said roller bars.

Other objects features and advantages of the present invention will become apparent to those skilled in the art from the following detailed description. It should be understood, however, that the detailed description and specific examples, while indicating preferred embodiments of the present invention are given by way of illustration and not limitation. Many changes and modifications within the scope of the present invention may be made without departing from the spirit thereof, and the invention includes all such modifications.

BRIEF DESCRIPTION OF THE DRAWINGS

An exemplary embodiment of the invention is described in greater detail below with reference to the accompanying drawings, wherein:

FIG. 5 is the arrangement of a flexible pressure pad on a steel belt in side view;

FIG. 6 is the arrangement of the pressure pad according to FIG. 5 in front view.

BRIEF DESCRIPTION OF THE EMBODIMENTS

Figure 1:
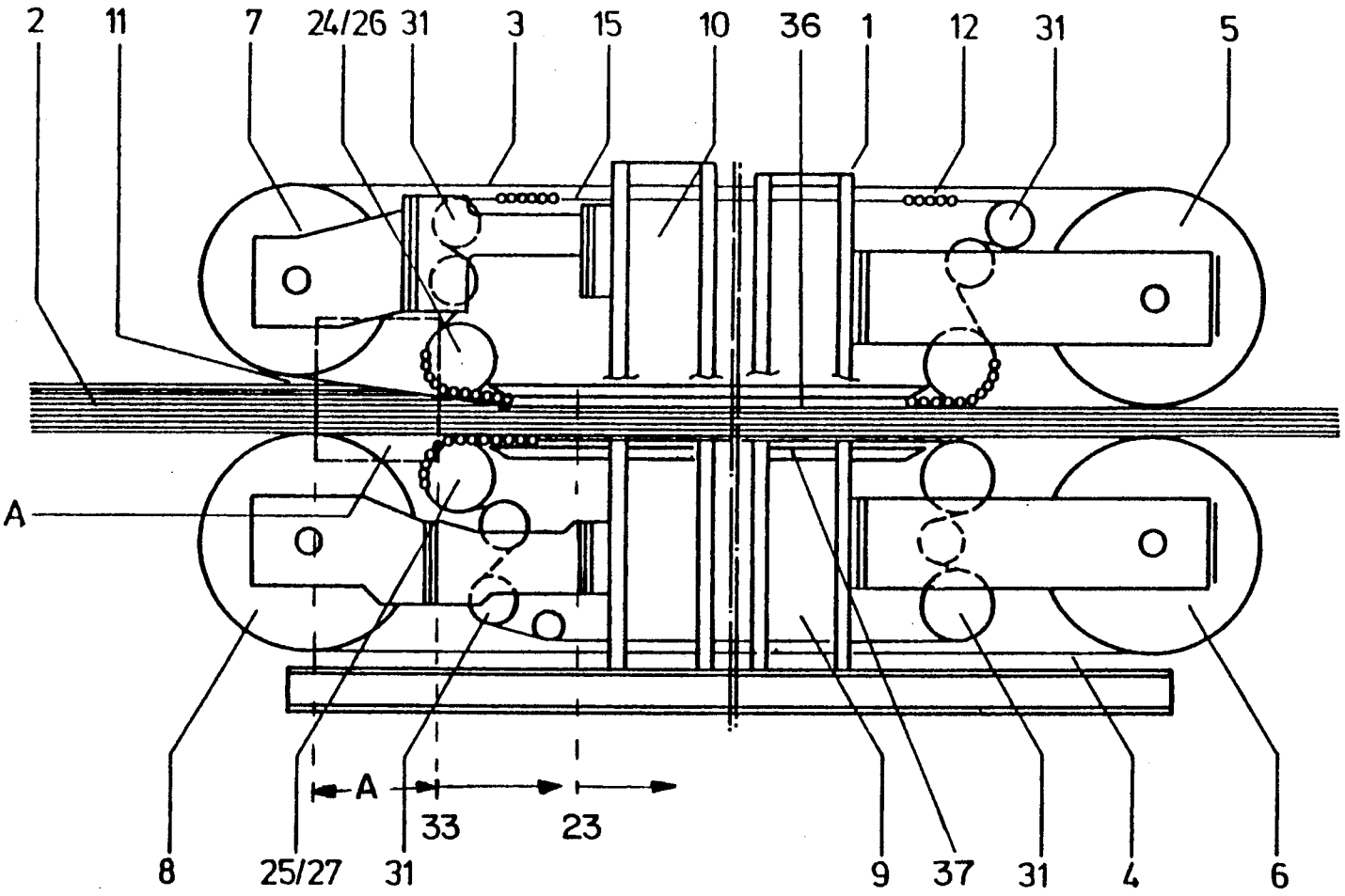
FIG. 1 is a side view of the continuously working press according to an embodiment of the invention in a schematic representation.

Referring to FIG. 1, there is shown a continuously working press 1 having a press table 9, a movable press ram 10 and tension columns (not shown) connecting them. To set a press gap 11, press ram 10 is moved up and down by hydraulic piston-cylinder arrangements (not shown) and then locked in the selected position. Steel belts 3 and 4 are each run around press table 9 and press ram 10 by drive drums 5 and 6 and tail drums 7 and 8. Heating plates 36 and 37 are attached to the underside of the press ram 10 and the upper side of press table 9, respectively. Heating plates 36 and 37 are adapted to transfer heat through roller bars 12 and steel belts 3 and 4 and into the material 2. To reduce friction between heating plates 36 and 37 and circulating steel belts 3 and 4, one roller-bar carpet each, formed from roller bars 12, is likewise located between steel belts 3 and 4, and heating plates 36 and 37 moving in a circulating manner. Roller bars 12, the axes of which extend transversely to the passage direction of the belt, are joined together at a predetermined pitch dimension at both longitudinal sides of press 1 with plate link chains 15 and pass between heating plates 36 and 37 of press ram 10 and press table 9 on one side and steel belts 3 and 4 on the other side. Roller bars 12 move in a rolling manner and as a result carry a material 2 to be pressed along with them.

It is further apparent from FIGS. 1 to 4 that roller bars 12, by insertion sprockets 24 and 25, and plate link chains 15, and by two entry sprockets 26 and 27 arranged to the side of the entry heating plate, are inserted positively and non-positively into the horizontal press plane. Insertion sprockets 24 and 25 are fastened to press ram 10 and press table 9, respectively. Entry sprockets 26 and 27 are fastened to press ram 10 and press table 9, respectively, each being fixed on a spindle. Numeral 33 indicates the start of the entry area of roller bars 12 leading into the press zone, and numeral 23 indicates the end of the press zone as well as the start of the high-pressure zone. Numeral 33 also represents the entry tangent of insertion sprockets 24 and 25 and thus the start of contact between roller bars 12 and steel belts 3 and 4 of press table 9 and press ram 10. The circulation of roller bars 12 in press table 9 and press ram 10 is shown via guide pulleys 31.

Figure 2:
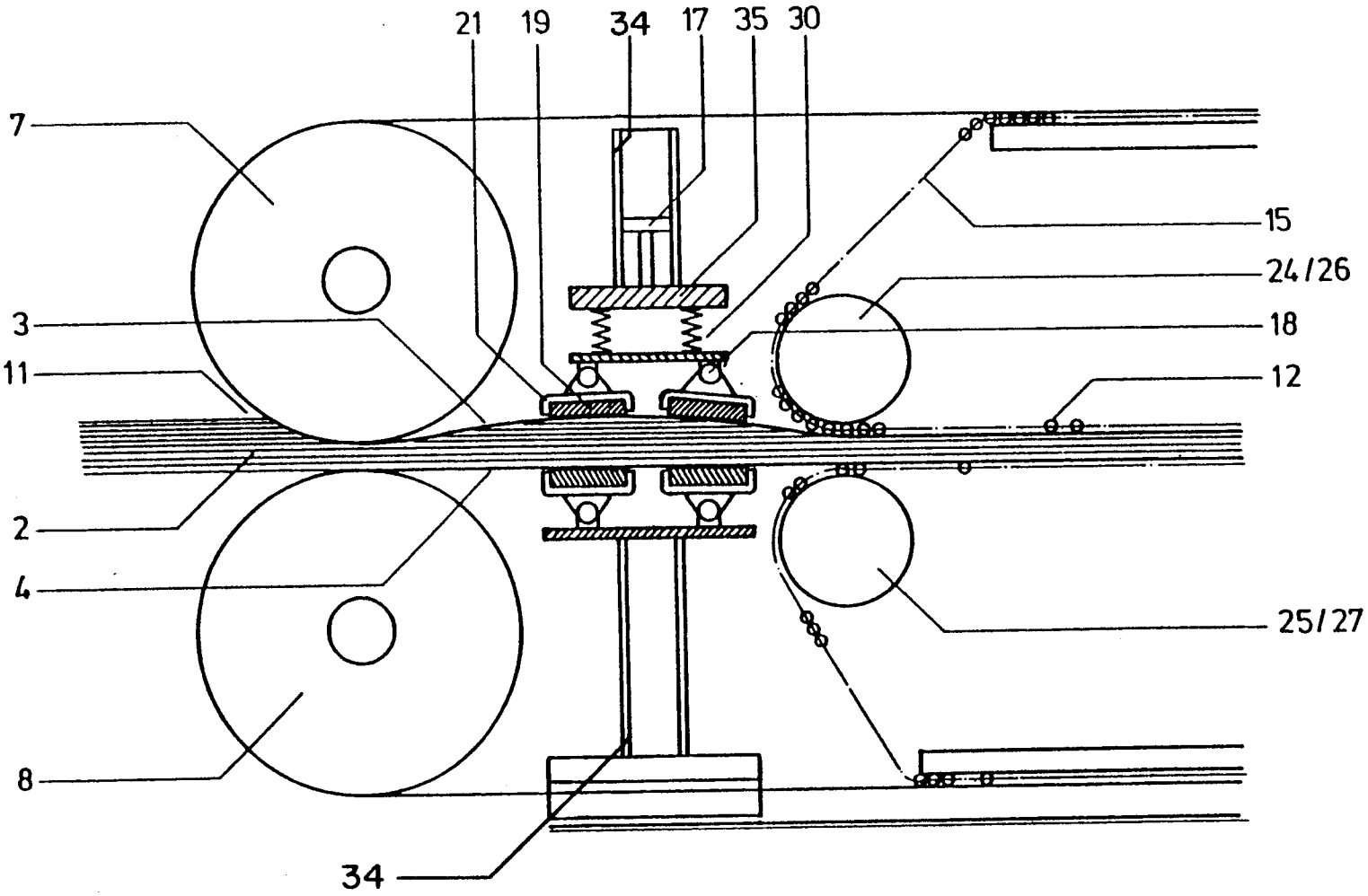
FIG. 2 is an enlarged view of the feeding area of the press according to FIG. 1.
Figure 3:
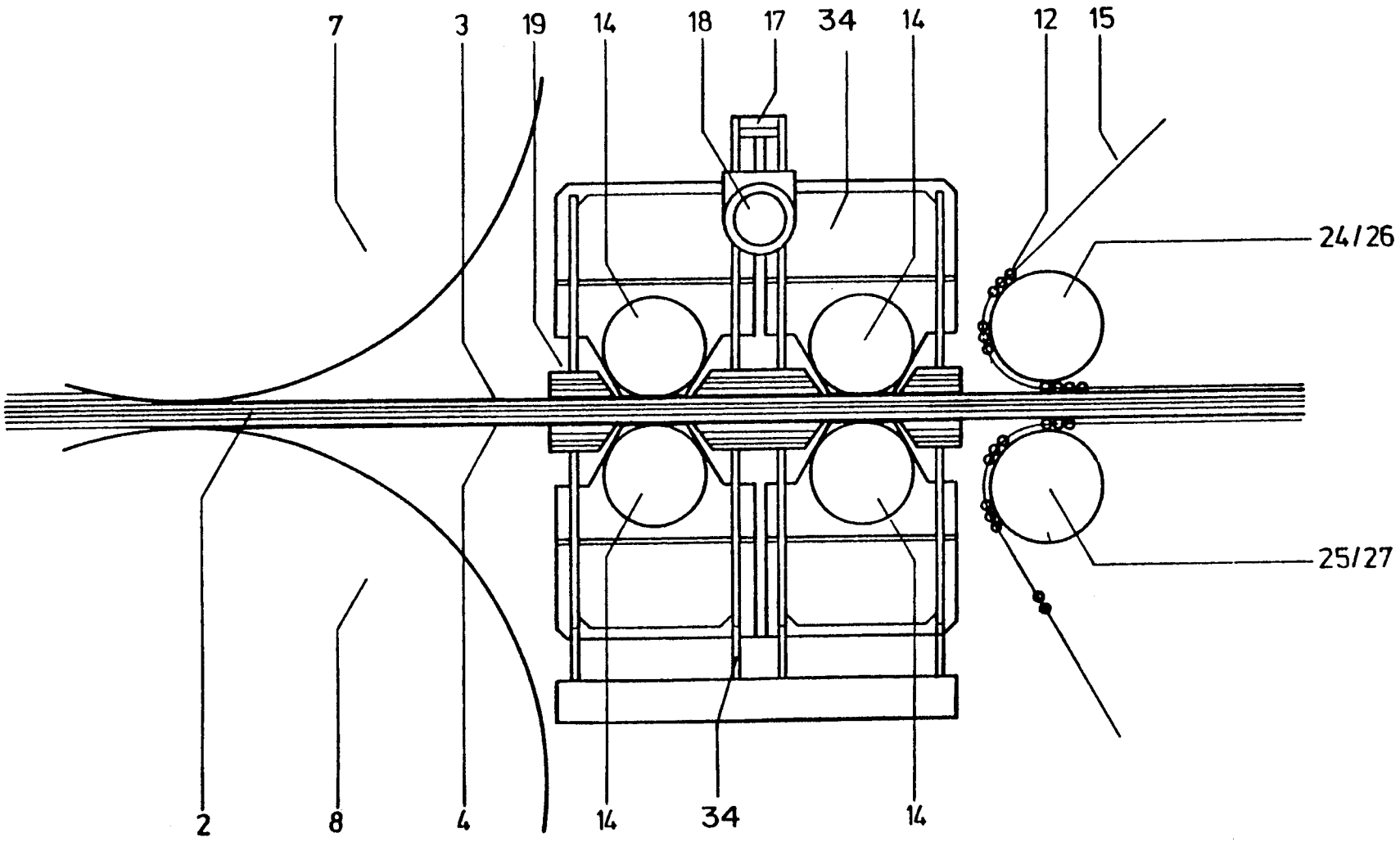
FIG. 3 is a second configuration of the feeding area according to FIG. 2.
Figure 4:
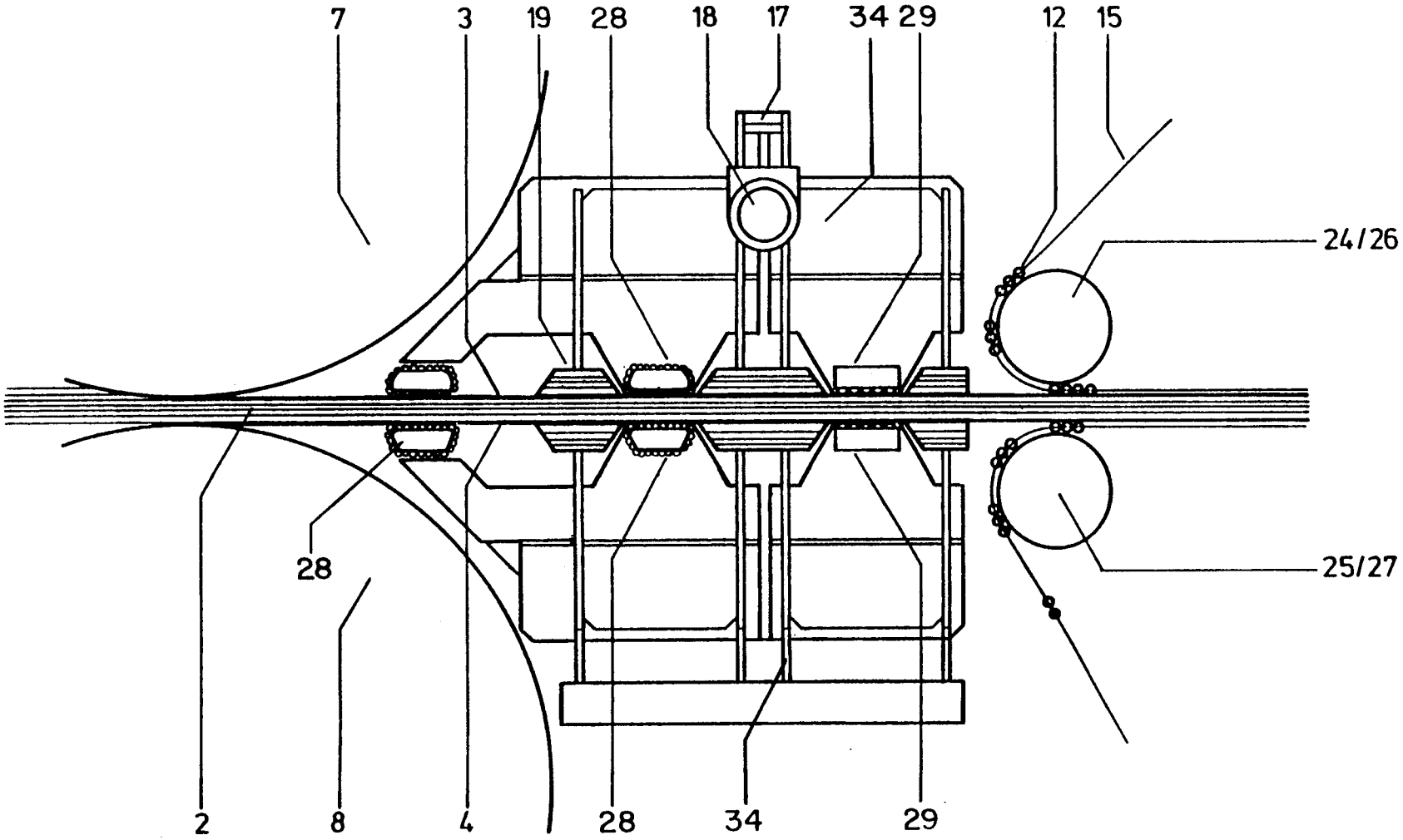
FIG. 4 is a third configuration of the feeding area according to FIG. 2.

Referring to FIGS. 2 to 4, various flexible heat-transfer systems consisting of combinations of rigid tubes 13, heating bars 16, spring elements or hydraulic actuators 17, articulations 18, pressure pads 19, heating hoses 20, brackets 21 and wear plates 22 are arranged in the feeding area "A" of the press between the tail drums 7 and 9 on the one side and the insertion sprockets 24 and 25 on the other side. The actuators apply a pressure of 0–2 bar through the pack 19 and onto the belts 3 and 4. These heat-transfer systems, by making elastic contact over their full surface, give off their installed heat to steel belts 3 and 4 and thus to material 2 to be pressed.

These heat transfer systems, according to FIGS. 5 and 6, in this case comprise flexible heating hoses 20. According to FIG. 7, the flexible heat transfer system comprises rigid tubes 13 and/or heating bars 16. In each case, the hoses 20, rigid tubes 13, and heating bars 16 are fixed inside bracket 21 by means of wear plate 22. Heating media flows through the heating hoses 20 and the tubes 13, whereas heating bars 16 mounted in tubes 13 are supplied with electrical energy. In still another embodiment of the invention, a combination of heating hoses 20, rigid tubes 13, and heating bars 16 can be fixed inside the bracket 21 by means of the wear plate 22.

Heating hoses 20 as illustrated in FIG. 5 are preferably produced from heat-resistant material such as "TEFLON" or "VITON".

As illustrated in FIG. 2, the heat transfer system includes brackets 21 supported against articulations 18 and suspended by means of springs 30 which are connected to an articulated plate 35 which in turn is connected to hydraulic actuators 17. Heated pressure pads 19 fixed within brackets 21 and are pressed against steel belts 3 and 4 either by spring elements or by hydraulic actuators 17.

Figure 7:
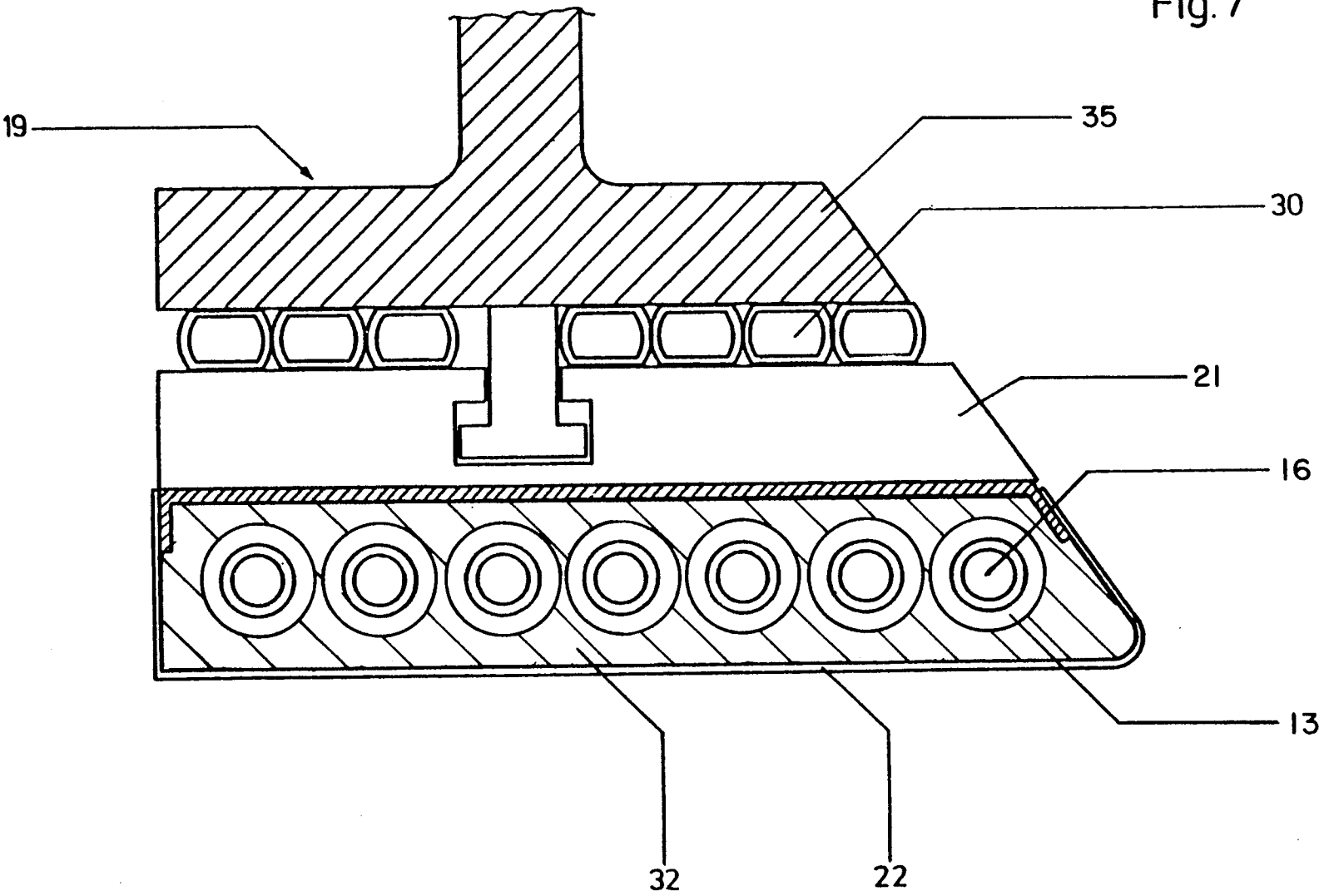
FIG. 7 illustrates the construction of a flexible pressure pad having heating tubes and heating bars.

For making an elastic contact via wear plate 22, rigid tubes 13 and/or heating bars 16 are surrounded according to FIG. 7 inside bracket 21 by metal powder 32.

FIGS. 3 and 4 illustrate that there are a plurality of heat transfer systems cooperating with steel belts 3 and 4. In FIG. 3, readily heatable pressure rolls 14 are located between consecutive heat transfer systems for providing desired pre-compression of material 2. In FIG. 4, heatable roller circulation shoes 28 and heatable roller cartridges 29 are arranged between and in front of the consecutive heat transfer systems providing desired pre-compression of material 2. Heated pressure pads 19, pressure rolls 14, roller circulation shoes 28 and roller cartridges 29 are all supported in press frame 34 which spans steel belts 3 and 4.

The various heat-transfer systems illustrated in FIGS. 2 to 7 are located in the feeding area "A" and are provided with wear plate 22 which has at least the flexibility of steel belts 3 and 4 and must have a softer consistency than steel belts 3 and 4 so that the wear caused by the rubbing between steel belts 3 and 4 and wear plate 22 occurs principally on wear plate 22. Wear plate 22 can be easily exchanged when required.

What is claimed is:

1. A continuously working heating-plate press comprising:

(a) a press frame;

(b) a press ram and a press table connected to said press frame to define an adjustable press gap located in a pressing region positioned therebetween;

(c) first and second endless steel belts adapted to transmit a pressing force to a material to be pressed and to draw said material through said press gap;

(d) driving drums and tail drums adapted to guide said first and second endless steel bands around said press ram and said press table respectively;

(e) a plurality of revolving roller bars adapted to support said steel belts as they travel through said press, said roller bars having axes of rotation transverse to the direction of said steel belts;

(f) a pair of heating plates positioned in an area which is located downstream of an initial point of contact between said steel belts and said roller bars, said heating plates being attached to an upper side of the press table and an underside of said press ram, respectively, each of said heating plates being adapted to transfer heat through said roller bars and said steel belts and into said material to be pressed; and (g) first and second flexible heat transfer systems cooperating with said first and second steel belts, respectively, each of said heat transfer systems being detached from said heating plates, being heated independently of said heated plates, and being located within a feeding area located between said tail drums and said initial point of contact between said steel belts and said roller bars and being adapted to heat said material to be pressed when said material to be pressed is conveyed through said feeding area.

2. A continuously working press as claimed in claim 1, wherein each of said first and second flexible heat transfer systems comprise:

(a) a plurality of flexible pressure pads adapted to make full surface contact with said steel belts by acting elastically on said steel belts;

(b) a heating media which flows through said pressure pads providing heat to said material;

(c) compressive means for pressing said pressure pads onto the surface of said steel belts; said compressive means connected to said press frame and said pressure pads.

3. A continuously working press as claimed in claim 2, wherein said compressive means comprises at least one of hydraulic actuators, pneumatic actuators, and spring elements.

4. A continuously working press as claimed in claim 3, wherein said compressive means exerts a force through said pressure pads and into said steel belts in a contact-pressure range of 0–2 bars.

5. A continuously working press as claimed in claim 2, wherein said pressure pads further comprise a bracket and a wear plate, said bracket being connected to articulations which are connected to said compressive means, said pressure pads being enclosed by said wear plate, said wear plate being opposite said bracket.

6. A continuously working press as claimed in claim 5, wherein said pressure pads comprise elastic hoses made of at least one of Teflon and Viton.

7. A continuously working press as claimed in claim 5, wherein said pressure pads further comprise rigid tubes arranged transversely to the feed direction of said steel belts, said rigid tubes being separated from said wear plate by a gap filled with a metal powder.

8. A continuously working press as claimed in claim 5, wherein said pressure pads further comprise rigid electrical heating bars arranged transversely to a feed direction of said steel belts, said electrical heating bars being separated from said wear plate by a gap filled with a metal powder.

9. A continuously working press as claimed in claim 1, further comprising:

(a) first and second series of flexible heat transfer systems cooperating with said first and second steel belts, respectively,; and (b) a readily heatable pressure roll located in each case between two of said heat transfer systems within the first and second series of flexible heat transfer systems.

10. A continuously working press as claimed in claim 1, further comprising:

(a) a first and second series of flexible heat transfer systems cooperating with said first and second steel belts, respectively; and (b) a rigid rolling pressure transfer system arranged in front of each of said heat transfer systems within the first and second series of heat transfer systems.

11. A continuously working press as claimed in claim 10, wherein the pressure transfer system comprises roller circulation shoes.

12. A continuously working press as claimed in claim 11, wherein said circulation shoes are heatable.

13. A continuously working press as claimed in claim 10, wherein the pressure transfer system comprises roller cartridges.

14. A continuously working press as claimed in claim 13, wherein said roller cartridges are heatable.

15. A method of heating a continuously working heating-plate press comprising the steps of:

(a) providing a press frame;

(b) providing a press ram and a press table connected to said press frame to define an adjustable press gap located in a pressing region positioned therebetween;

(c) rotating first and second endless steel belts adapted to transmit a pressing force to a material to be pressed and to draw said material through said press gap;

(d) guiding said first and second endless steel belts around said press ram and said press table, respectively, via driving drums and tail drums;

(e) supporting said steel belts on a plurality of revolving roller bars as said steel belts travel through said press, said roller bars having axes of rotation transverse to the direction of said steel belts;

(f) transferring heat through said roller bars and said roller belts and into said material to be pressed from a pair of heating plates, said heating plates being positioned in an area which is located downstream of an initial point of contact between said steel belts and said roller bars, said heating plates being attached to an upper side of said press table and an underside of said press ram respectively; and (g) transferring heat to said material to be pressed from first and second flexible heating systems which are detached from said heating plates, which are heated independently of said heated plates, and which cooperate with said first and second steel belts, respectively, and which are located in a feeding area of said press located between said tail drums and said initial point of contact between said steel belts and said roller bars.

* * * * *